US007661525B1

(12) United States Patent
Sandy

(10) Patent No.: US 7,661,525 B1
(45) Date of Patent: Feb. 16, 2010

(54) COLLAPSIBLE PILL CUP WITH TIMER

(75) Inventor: Bonni Shevin Sandy, Morton Grove, IL (US)

(73) Assignee: Dard Products, Inc., Evanston, IL (US)

( * ) Notice: Subject to any disclaimer, the term of this patent is extended or adjusted under 35 U.S.C. 154(b) by 0 days.

(21) Appl. No.: 12/342,930

(22) Filed: Dec. 23, 2008

(51) Int. Cl.
*B65D 77/00* (2006.01)

(52) U.S. Cl. ..... 206/218; 206/217; 206/528

(58) Field of Classification Search ..... 206/216, 206/217, 218, 223, 546, 570, 577, 528, 534, 206/540
See application file for complete search history.

(56) References Cited

U.S. PATENT DOCUMENTS 3,285,459 A * 11/1966 Gahm ..... 220/8
3,434,589 A * 3/1969 Valtri et al. ..... 206/218
4,940,138 A 7/1990 Hornstein
6,126,010 A 10/2000 Kogen
6,666,329 B1 * 12/2003 Charbonneau ..... 206/218
6,736,285 B2 5/2004 Stewart-Stand

* cited by examiner

*Primary Examiner*—J. Gregory Pickett
(74) *Attorney, Agent, or Firm*—Kenneth H. Ohriner; Perkins Coie LLP

(57) ABSTRACT

A pill case has an oblong base with pill spaces on opposite sides of a cup holder in the base. A collapsible cup is provided within the cup holder. A lid has an accessory housing. The lid is attached to the base via a hinge or fold joint. The lid may have a lower edge or lip generally having the same shape as an upper edge, lip or groove on the base, to form a clamshell-type container. The accessory housing fits into the cup within the cup holder when the pill case is closed. An electronic accessory, such as a clock, may be contained within the accessory housing.

12 Claims, 2 Drawing Sheets

COLLAPSIBLE PILL CUP WITH TIMER

FIELD OF THE INVENTION

The field of the invention is containers for holding pills and the like.

BACKGROUND OF THE INVENTION

Various container devices have been proposed for use in carrying pills and the like. Some of these devices are compact and may be easily carried in a pocket or purse, while protecting the contents. Since users typically take pills with water, various portable or collapsible drinking cups have also been proposed. Some container devices have even combined a storage receptacle with a collapsible drinking cup, so that users need only carry a single device. While these types of devices have met with varying degrees of success, an improved combination pill container and drinking cup is needed.

SUMMARY OF THE INVENTION

In one aspect of the invention, a pill case has an oblong base with pill spaces on opposite sides of a cup holder in the base. A collapsible cup is provided within the cup holder. A lid has an accessory housing. The lid is attached to the base via a hinge or fold joint. The lid may have a lower edge or lip generally having the same shape, or a shape similar to the shape of an upper edge, lip or groove on the base. In this aspect, the lid and the base may form a clamshell-type container. The accessory housing may extend into the cup within the cup holder when the pill case is closed. An electronic accessory may be contained within the accessory housing.

In another aspect of the invention, a combination drinking cup and pill case, includes an elliptical or oval base and a cup holder centrally positioned in the base. A collapsible cup fits within the cup holder. First and second crescent-shaped pill spaces are formed in the base on opposite sides of the cup holder. A lid is attached to the base and adapted to mate with the base to form a closed container. An accessory housing is attached to the lid, with the accessory housing extending into an open top end of the cup held within the cup holder in the base. An electronic accessory, such as a digital clock, may be provided within the accessory housing, with a display on the lid associated with the electronic accessory.

In another aspect, the cup may include a coil spring, and a sleeve attached to the spring. Other and further objects and advantages will become apparent from the following detailed description.

BRIEF DESCRIPTION OF THE DRAWINGS

In the drawings, the same element indicates the same element in each of the views.

DETAILED DESCRIPTION OF THE DRAWINGS

Figure 1:
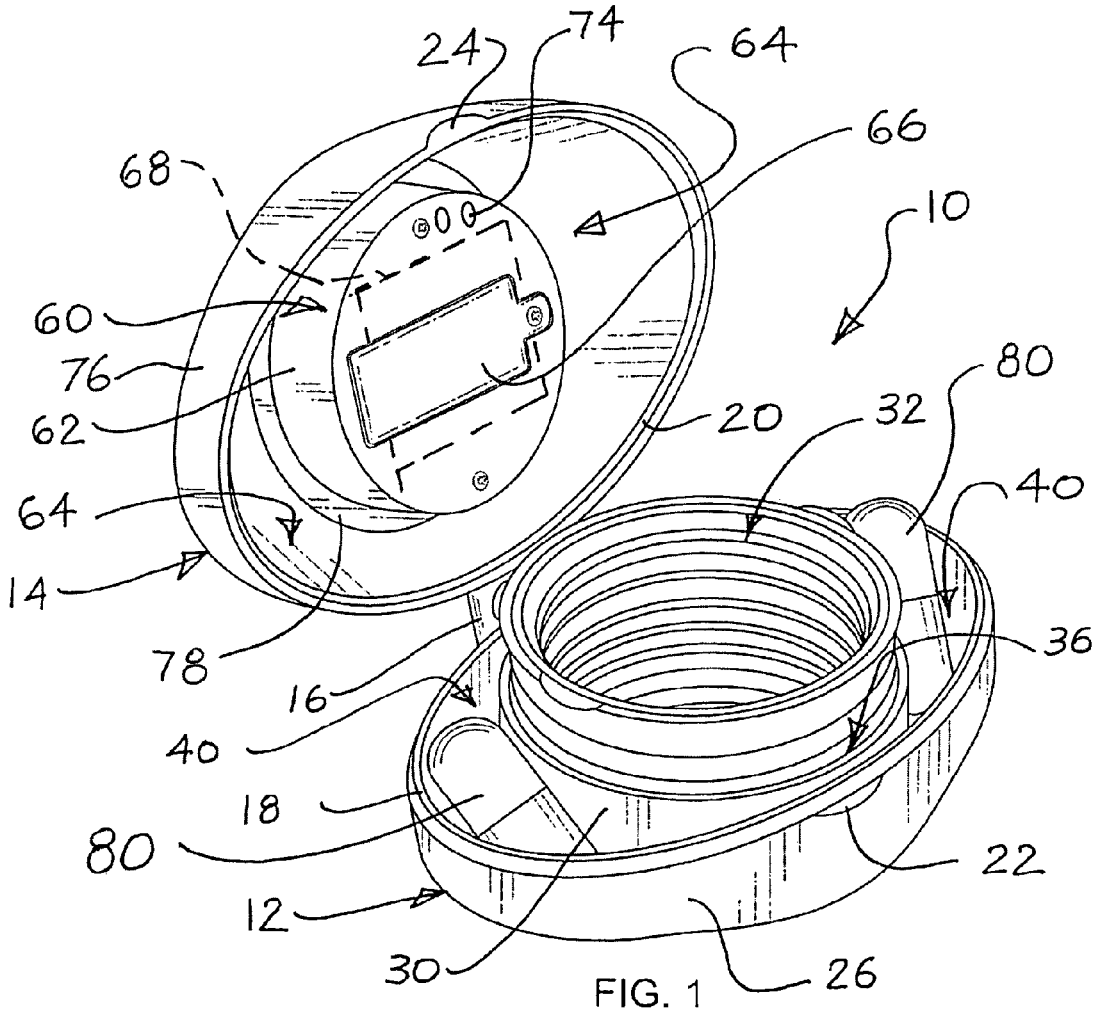
FIG. 1 is a perspective view of a new pill case and drinking cup, with the pill case in the open position and the drinking cup collapsed.

As shown in FIG. 1, a pill case 10 includes a base 12 attached to a lid 14 via a hinge 16. The base 12 may have an upper lip 18 extending around an upper edge of the base. Correspondingly, the lid 14 may have a groove or slot 20 extending around a lower edge of the lid, with the groove adapted to receive the lip 18, when the pill case 10 is in the closed position shown in FIG. 2. Alternatively the positions of the lip 18 and the groove 20 may be reversed, or the mating edges of the base 12 and the lid 14 may be simply angled or flat, with no lip or groove used.

Figure 2:
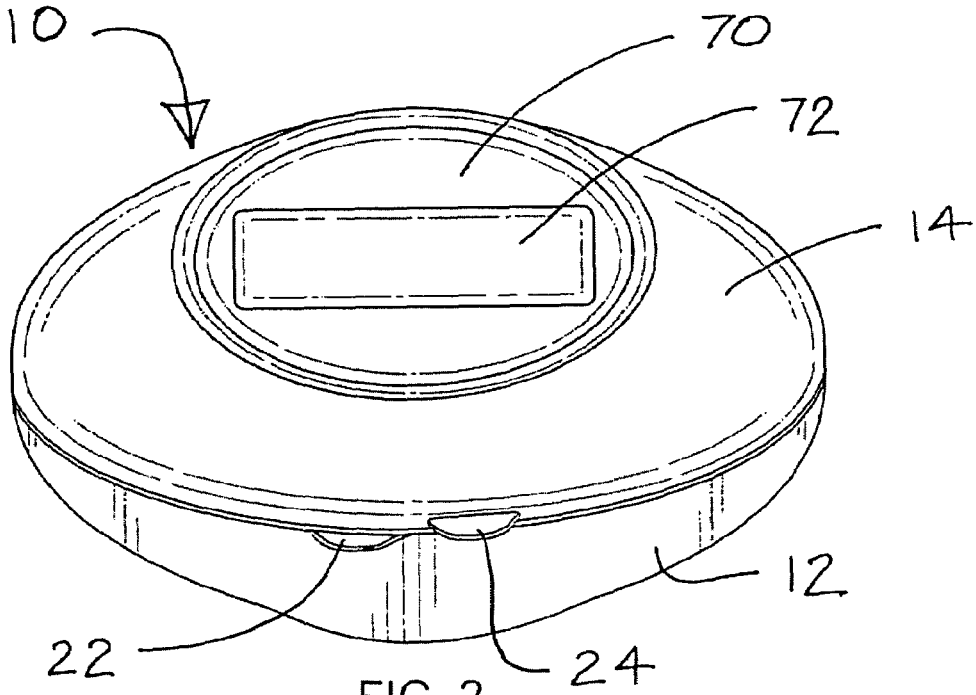
FIG. 2 is a top and front perspective view of the pill case shown in FIG. 1, with the pill case now closed.

The hinge 16 may be a traditional hinge joint, a detent or snap open/close device, or a simple tether. A detent or snap hinge device is useful for positively holding the pill case 10 into the open position shown in FIG. 1 or into the closed position shown in FIG. 2. A base tab 22 may be provided on the base, on the front of the pill case 10, as shown in FIG. 1. A lid tab 24 may similarly be provided on the lid, adjacent to the base tab 12, as shown in FIG. 2. The base tab 22 and the lid tab 24 can provide a convenient finger grasping surface, for opening the pill case 10.

The base 12 and the lid 14, in the specific embodiment shown, are both oblong and have a generally oval or elliptical shape, when viewed from above. The base 12 and the lid 14 may have the same or similar shape and dimensions, forming a clamshell design when closed, as shown in FIG. 2. In the design shown, the base 12 has generally flat sidewalls 26 joined to a flat bottom surface. A flat bottom surface on the base allows the pill case 10 to sit on a flat surface, such as a table surface, without rocking. The lid 14 may similarly have a central flat top surface 70, as shown in FIG. 2. The flat bottom surface on the base 12 may be a mirror image of the flat top surface 70 on the lid.

Referring to FIG. 1, a cup holder 30 is provided in the base 12, typically at a central location of the base. A recess 36 in the cup holder 30 is dimensioned to hold a collapsible cup 32, shown in FIGS. 1 and 3. The cup holder 30 may be a cylindrical shell extending up from a bottom surface of the base 12. The cup holder 30 may be tangent to, and/or integral with, the sidewalls 26 of the base 12, or spaced slightly inward from the sidewalls, as shown in FIG. 1. Also as shown in FIG. 1, crescent-shaped pill spaces 40 are formed in the base 12 between the sidewalls 26 of the base 12 and the cup holder 30. FIG. 1 shows one pill or capsule 80 in each of the spaces 40. Of course, more pills 80 may be contained in the spaces 40 depending on the relative sizes of the spaces and the pills.

Figure 3:
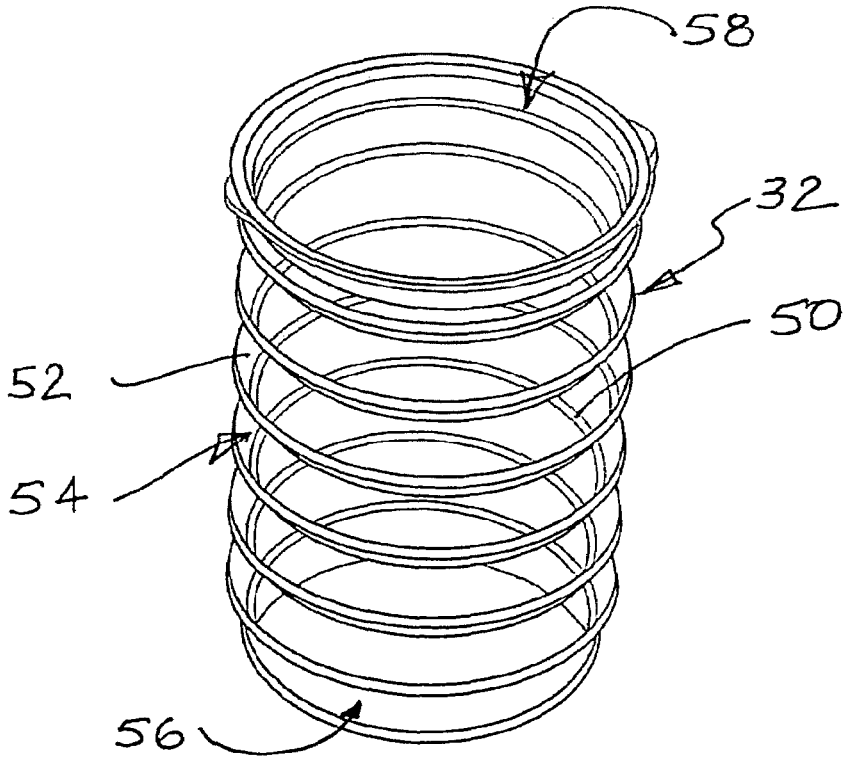
FIG. 3 is a perspective view of the drinking cup shown in FIG. 1, now removed from the case and extended.

Turning to FIG. 3, various forms of the collapsible drinking cup 32 may be used. In one design, the cup 32 includes a sleeve 52 formed with rings 50. The rings 50 are sufficiently rigid to allow the user to firmly grasp and hold the cup 32, without significantly deforming or crushing the cup 32. The sleeve 52 has flexible tubular sidewall sections 54 between the rings 50. An upper ring 50 forms an open top end 58 of the cup 32. The bottom end 56 of the cup 32 is closed. The sleeve 50 is made of a water-impermeable material, such as plastic. FIG. 3 shows the cup 32 in an extended or un-collapsed position. FIG. 2 shows the cup 32 in a collapsed position. Other forms of collapsible cups, including cups with telescoping interlocking ring sections, spring-forms, etc. may alternatively be used.

Referring back now to FIG. 1, an accessory housing 60 is attached to, or formed on, the lid 14. An accessory 68 is contained within the housing 60. The accessory may be a clock, a timer, a pedometer, alarm, or various other electronic devices. A display 72 on the lid 14 is part of or electrically connected to, the accessory within the accessory housing. A door 66 may be provided on the accessory housing 60 for access to a battery compartment within the accessory housing. Switches, buttons, or other electronic controls 74 may also be provided on the accessory housing, to operate various functions of the accessory 68. Crescent-shaped lid spaces or recesses 64 are formed in the lid between the cylindrical accessory housing 62 and the sidewalls 76 of the lid 14. The recesses 64 are aligned with, and similar in shape to, the pill spaces 40 in the base 12.

The accessory housing 62 has a cylindrical shape and is dimensioned and positioned so that when the pill case 10 is closed, the accessory housing 60 fits within the open top end 58 of the cup 32. This provides for a compact design. In the design shown, the diameter of the rings 50 of the cup 32 are nominally smaller than the inside diameter of the cup holder 30, to allow the cup to slide into and out of the cup holder. In turn, the diameter of the accessory housing 60 is nominally smaller than the inside diameter of the cup 32, to allow the accessory housing 60 to fit within the cup.

In use, pills, capsules, etc. are loaded into the pill spaces 40. The accessory 68 is turned on or reset as desired. The lid is then closed, providing a compact and convenient pill case 10. The pill case 10 may be opened when desired, and the cup 32 removed and extended for use. A seal 78 may be provided on the lid, to seal against the top rim of the cup 32, or the top rim of the cup holder 30. The seal 78, if used, may help to keep pills 80 dry within the pill case 10, even if the cup is replaced into the pill case 10 with residual water in the cup.

Thus, a novel pill case has been shown and described. Various changes and substitutions may of course be made without departing from the spirit and scope of the invention. The invention, therefore, should not be limited, except to the following claims and their equivalents.

The invention claimed is:

1. A pill case, comprising:

an oblong base having first and second pill spaces on opposite sides of a cup holder formed in the base;

a groove around a perimeter of the base;

a collapsible cup within the cup holder, with the cup having an open top end;

a lid having first and second pill recesses on opposite sides of an accessory housing attached to the lid;

a lip around a perimeter of the lid;

a hinge pivotably attaching the lid to the base; and the lid moveable from an open position, wherein the cup and pill spaces are accessible, to a closed position, wherein the accessory housing is positioned within the open top end of the cup, and the lip is engaged with the groove, and the base and lid forming an enclosed compartment for holding pills.

2. The pill case of claim 1 further comprising an electronic device within the accessory housing, and a display on the lid associated with the electronic device.

3. The pill case of claim 1 wherein the base and the lid are elliptical or oval.

4. The pill case of claim 1 wherein the cup holder has a diameter substantially equal to the width of the base.

5. The pill case of claim 1 further comprising a base tab on the base and a lid tab on the lid, and a latch for snapping the lid and cover into the closed position.

6. The pill case of claim 1 with the accessory case having a height substantially equal to the height of the cup holder.

7. The pill case of claim 1 with the cup comprising a coil spring, and a plastic sleeve attached to the spring.

8. The pill case of claim 1 with the first and second pill spaces and recesses formed into the shape of a crescent.

9. The pill case of claim 1 with the base and the lid each having a flat exterior surface having a diameter larger than a diameter of the cup holder.

10. A combination drinking cup and pill case, comprising:

an elliptical or oval base;

an upper edge on the base;

a cup holder centrally positioned in the base;

first and second crescent-shaped pill spaces in the base on opposite sides of the cup holder;

a collapsible cup within the cup holder, with the cup having an open top end;

a lid having a lower edge matching the shape of the upper edge;

an accessory housing attached to the lid, with the accessory housing extending into an open top end of the cup;

an electronic accessory within the accessory housing, and a display on the lid associated with the electronic accessory;

first and second crescent-shaped pill recesses on opposite sides of the accessory housing; and a hinge pivotably attaching the lid to the base.

11. The pill case of claim 10 with the cup comprising a coil spring, and a sleeve attached to the spring.

12. The pill case of claim 10 with the base and the lid each having a flat exterior surface having a diameter larger than a diameter of the cup holder.

* * * * *